US005858290A

United States Patent [19]

Oh et al.

[11] Patent Number: 5,858,290

[45] Date of Patent: Jan. 12, 1999

[54] DIFFERENT SHRINKAGE MIXED YARN AND METHOD OF PRODUCING SUCH

[75] Inventors: Young-Soo Oh, Kyunggi-do; Young-Geun Choi, Seoul; Kyoung-Woo Kim, Kyunggi-do, all of Rep. of Korea

[73] Assignee: Sunkyong Industries Limited, Kyunggi-do, Rep. of Korea

[21] Appl. No.: 935,297

[22] Filed: Sep. 22, 1997

[30] Foreign Application Priority Data

Mar. 23, 1996 [KR] Rep. of Korea ..... 1996-41576
Dec. 31, 1996 [KR] Rep. of Korea ..... 1996-80490

[51] Int. Cl.[6] ..... D02G 3/00; D02G 3/04

[52] U.S. Cl. ..... 264/103; 364/171.1; 364/177.13; 364/210.8

[58] Field of Search ..... 364/103, 171.1, 364/177.13, 210.8

[56] References Cited

U.S. PATENT DOCUMENTS 4,025,595 5/1977 Mirhej ..... 264/103

FOREIGN PATENT DOCUMENTS 7-243144 9/1995 Japan .

*Primary Examiner*—Leo B. Tentoni
*Attorney, Agent, or Firm*—Browdy and Neimark

[57] ABSTRACT

A different shrinkage mixed yarn is produced using core and effect yarns, which are selected from the same or different polymer and have different thermal shrinkage percentages. The core and effect yarns, which are spun from different spinnerets of a spin draw spinning machine, are doubled and interlaced into a mixed yarn prior to being taken up by a take-up machine, with the core yarn passing through a direct drawing yarn passage and the effect yarn passing through a bypassed yarn passage. The core yarn is drawn and thermally fixed due to a difference in the rotating speed between first and second godet rollers, while the effect yarn is drafted due to the rotating speed of the take-up machine so that the effect yarn has properties of a POY.

13 Claims, 2 Drawing Sheets

DIFFERENT SHRINKAGE MIXED YARN AND METHOD OF PRODUCING SUCH

BACKGROUND OF THE INVENTION

1. Field of the Invention

The present invention relates, in general, to a different shrinkage mixed yarn produced by mixing the same or different grey yarns having different thermal shrinkage and, more particularly, to a method of producing such mixed yarns.

2. Description of the Prior Art

In the prior art, different shrinkage mixed yarns are produced through the following two methods. That is, such mixed yarns may be produced by separately spinning two different grey yarns prior to mixing the separately spun grey yarns into a single yarn at a drawing step. Alternatively, such mixed yarns may be produced by mixing two different grey yarns into a single yarn after the two different grey yarns are separately spun and drawn. However, the two methods for producing mixed yarns are problematic in that they individually have a long and multi-step process, thus increasing the production cost of the resulting yarns and causing the appearance of the resulting yarns to be spoiled. Another problem experienced in the above methods is that the separately processed core and effect yarns have to be doubled into a single yarn, thus causing a difference in dyeing exhaustion between the core and effect yarns and reducing the quality of fabrics produced by the resulting mixed yarns. Such a problem caused by the difference in the dyeing exhaustion becomes worse when different polymers are used as high and low shrinkage parts of a resulting mixed yarn.

In the typical methods for producing mixed yarns, resulting yarns have to be produced with reduced productivity since the operational speeds of spinning and drawing machines used in the methods are limited. Such reduced productivity also increases the production cost of the resulting yarns.

Japanese Patent Laid-open Publication No. Hei. 7-243, 144 discloses a method of causing a desired difference in thermal shrinkage between core and effect yarns by making the thermosetting properties of the two yarns different. In the above Japanese method, the difference in thermosetting properties between the core and effect yarns is achieved by attaching a hot tube to a spin draw spinning machine. However, this method is problematic in that it has to be provided with a very expensive and awkward hot tube.

SUMMARY OF THE INVENTION

Accordingly, the present invention has been made keeping in mind the above problems occurring in the prior art, and an object of the present invention is to provide a simple method of producing different shrinkage mixed yarns, which is free from bad quality or spoiled appearance of the resulting yarns and improves productivity, and reduces the production cost of the resulting yarns.

Another object of the present invention is to provide a different shrinkage mixed yarn through the above method.

A further object of the present invention is to provide a woven fabric produced by weaving such mixed yarns.

In order to accomplish the above objects, the present invention provides a method of producing a different shrinkage mixed yarn using core and effect yarns, the core and effect yarns being selected from the same or different polymer and having different thermal shrinkage percentages, comprising the steps of: spinning the core and effect yarns from different spinnerets of a spin draw spinning machine; and doubling and interlacing the core and effect yarns into a mixed yarn prior to taking up the mixed yarn, with the core yarn passing through a direct drawing yarn passage and the effect yarn passing through a bypassed yarn passage which is free from drawing the effect yarn.

That is, in the method of this invention, the core yarn is produced through a normal spin draw yarn passage so that the core yarn is drawn and thermally fixed due to a difference in the rotating speed between the first and second godet rollers prior to being taken up by a take-up machine. Meanwhile, the effect yarn does not pass over any godet roller but passes through a bypassed yarn passage while being drafted due to the rotating speed of the take-up machine so that the effect yarn has properties of a POY.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
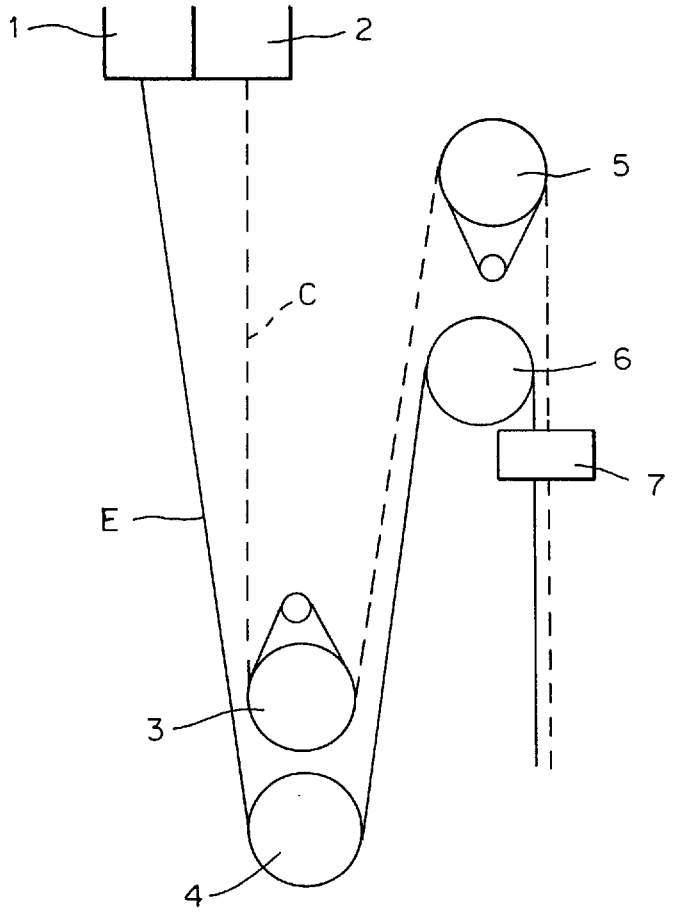
FIG. 1 is a view showing a device used in a method of producing different shrinkage mixed yarns in accordance with the primary embodiment of the present invention.

FIG. 1 shows a device used in a method for producing different shrinkage mixed yarns in accordance with the primary embodiment of this invention. In the method according to the primary embodiment of this invention, an effect yarn E is doubled and interlaced with a core yarn C into a different shrinkage mixed yarn at an interlacing nozzle 7, which is positioned in the front of a take-up machine (not shown). The effect yarn E is spun from a first spinneret 1 of a spin draw spinning machine and passes over first and second bypass rollers 4 and 6 in that order prior to being fed into the interlacing nozzle 7. The two bypass rollers 4 and 6 are not self-rotated but are rotated in conjunction with the take-up machine. Meanwhile, the core yarn C is spun from a second spinneret 2 of the spin draw spinning machine and passes over first and second godet rollers 3 and 5 prior to being fed into the interlacing nozzle 7. The mixed yarn is, thereafter, wound around a take-up roller of the take-up machine. In the above method, the effect yarn E practically maintains a non-drawn state or a POY state.

Figure 2:
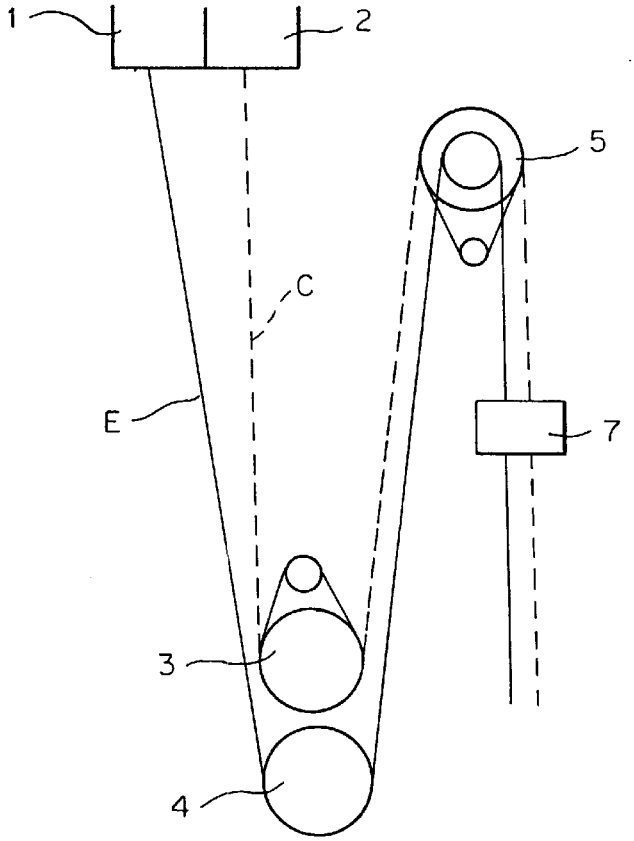
FIG. 2 is a view showing a device used in a method of producing different shrinkage mixed yarns in accordance with another embodiment of the present invention.
Figure 3:
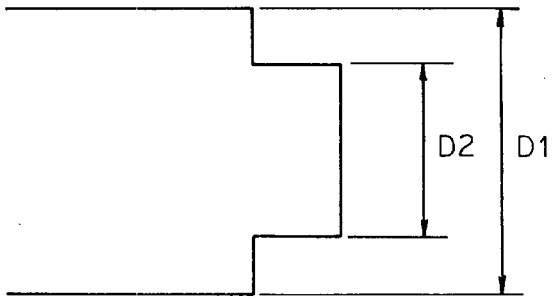
FIG. 3 is a view showing the configuration and construction of a second godet roller used in the device of FIG. 2.

Meanwhile, FIG. 2 shows a device used in a method of producing different shrinkage mixed yarns in accordance with another embodiment of this invention. This method does not use the second bypass roller 6 but uses a stepped godet roller as the second godet roller 5 different from the primary method. That is, the effect yarn E is spun from the first spinneret 1 of the spin draw spinning machine and passes over the first bypass roller 4 prior to passing over the small diameter part of the second godet roller 5. Meanwhile, the core yarn C is spun from the second spinneret 2 of the spinning machine and passes over the first godet roller 3 prior to passing over the large diameter part of the second godet roller 5. The effect yarn E is doubled with the core yarn C at the second godet roller 5, and are interlaced together at the interlacing nozzle 7, thus being produced into a different shrinkage mixed yarn. The mixed yarn is, thereafter, wound around a take-up roller of the take-up machine.

When the effect and core yarns E and C are mixed together at the second godet roller 5 as shown in FIG. 2, it is possible to increase the number of interlacing of the two yarns E and C. The effect yarn E, which passes over the small diameter part of the second godet roller 5, reduces the tensile force of the mixed yarn, thus effectively increasing the number of interlacing at the same atmospheric pressure.

The stepping percentage of the stepped godet roller 5 is ranged from 2% to 7% and preferably from 2% to 5%. The stepping percentage of the roller 5 is calculated by the following equation.

$$\text{Stepping percentage}=[(D_1-D_2)/D_1]\times 100(\%)$$

wherein, $D_1$ is the diameter of the large diameter part of the stepped roller, and $D_2$ is the diameter of the small diameter part of the stepped roller.

When the stepping percentage of the roller 5 is lower than the above-described range, it i s impossible to effectively increase the number of interlacing. Meanwhile, when the stepping percentage of the roller 5 is higher than the above-described range, the overfeed rate of the core and effect yarns C and E is exceedingly increased, thus causing the yarns C and E to be unexpectedly coiled around the roller 5 and reducing the processing effect while producing the mixed yarn.

In the present invention, it is preferable to use yarns, individually having high staple fineness, as the core and effect yarns in order to maintain both a desired shape of the resulting mixed yarns and a desired elasticity of fabrics made of the resulting mixed yarns. In the present invention, the staple fineness of the core yarn C is preferably set to 2–10 denier and, more preferably, to 2–8 denier. However, it should be understood that the staple fineness of the core yarn C may be changed in accordance with the use of the resulting fabrics. When the staple fineness of the core yarn C is exceedingly higher than the above range, the core yarn C regrettably reduces drapery of the resulting fabrics. Meanwhile, when the staple fineness of the core yarn C is exceedingly lower than the above range, the core yarn C causes the resulting fabrics to tremble and reduces the reaction elasticity of the resulting fabrics. The cross-section of the core yarn C may be preferably selected from circular and the other cross-sections. However, in order to maintain desired elasticity of resulting fabrics, it is more preferable to select the cross-section of the core yarn C from solid triangular, hollow circular, hollow triangular, hollow flat and solid flat cross-sections.

The effect yarn E determines both touching sense and external appearance of the resulting mixed yarn. The peach skin touching sense of the mixed yarn is improved in inverse proportion to the staple fineness of the effect yarn. In the present invention, the staple fineness of the effect yarn E is preferably set to 0.3–6 denier and, more preferably, to 0.3–5 denier. The cross-section of the effect yarn E may be preferably selected from various cross-sections and, more particularly, from circular or triangular cross-sections. The triangular cross-sections are particularly profitable to improve the polishing effect of the resulting mixed yarn.

In the present invention, the polymer for the core yarn may be the same as or different from the polymer for the effect yarn. The core yarn determines the high thermal shrinkage of the resulting mixed yarn so that the core yarn is preferably selected from high shrinkage polymers.

For example, in order to produce different shrinkage polyester mixed yarns, it is preferable to select the polymer for the core yarn from polyester which includes isophthalic acid of 5–20 mol % relative to terephthalic acid. When the content of the isophthalic acid is lower than the above percentage, the polymer fails to have a desired high shrinkage effect. Meanwhile, when the content of the isophthalic acid is higher than the above percentage, the thermal properties of the polymer is exceedingly reduced so that the polymer cannot be used as a core yarn. In the present invention, it is necessary to appropriately control the temperature of the godet rollers in accordance with properties of the high shrinkage polymer. That is, the second godet roller, which is a thermosetting roller, preferably has a temperature of 80°–120° C., which is lower than the roller temperature in the event of general polyester yarns by 10°–30° C. When the roller temperature is higher than the above range, the polymer loses the high shrinkage properties. Meanwhile, when the roller temperature is lower than the above range, the thermal shrinkage of the polymer is exceedingly reduced, thus causing the resulting fabrics to be stiff.

In the present invention, it is possible to conjugation-spin a basic color dyed yarn and general polyester resin in order to cause a dyeing exhaustion and special dyeing effect of the resulting mixed yarn. In the event of conjugation-spinning of the basic color dyed yarn and general polyester resin, it is possible to produce fabrics having the melange effect of a dim tone. The basic color dyed yarn is selected from polyester having dimethylsulfonate. In such a polyester, the content of dimethylsulfonate is preferably set to 0.5–5 mol % relative to dimethylterephthalic acid.

In addition, it is possible to produce fabrics having special effect by dyeing the core and effect yarns into different colors using different dyes.

In order to improve the deep color dyeing effect of the resulting fabrics, the spinning process may be performed with a deep color polymer. For example, when a deep color polymer is used as either the core or effect yarn, it is possible to achieve a desired dyeing exhaustion, thus producing a different shrinkage mixed yarn having two tones.

In addition, it is possible to conjugation-spin the core and effect yarns with different gloss. For example, semi-dull polymer and full-dull polymer, bright polymer and semi-dull polymer, bright polymer and full-dull polymer may be conjugation-spun, thus producing different shrinkage mixed yarn with core and effect yarns having a desired dyeing exhaustion.

Generally, a POY, which is spun at the spinning rate of 2,000–4,500 m/min, has a thermal shrinkage percentage of 30–70%. When the POY is heated during a sizing step of a weaving process, the thermal shrinkage percentage of the POY is reduced to −5% to 5%. In the method of this invention, the winding speed of the resulting mixed yarn is preferably ranged from 2,000 m/min to 5,000 m/min and, more preferably, ranged from 2,500 m/min to 4,500 m/min. When the winding speed of the mixed yarn is lower than the above range, the strength of the mixed yarn is remarkably reduced with the elongation of the mixed yarn being exceedingly increased so that the mixed yarn cannot be used as a fiber. Meanwhile, when the winding speed of the mixed yarn is higher than 5,000 m/min, the mixed yarn has properties similar to those of a drawn yarn, thus failing to have the POY effect which has to be provided in the effect yarn.

The effect yarn is taken up by the take-up machine while being drafted by the winding speed of the take-up machine. Therefore, it is preferable to reduce the spinning tension of the effect yarn until the effect yarn is taken up by the take-up machine. That is, in order to reduce the frictional force between the effect yarn and the guides when the effect yarn passes over the guides before the effect yarn is taken up by the take-up machine, the guides are preferably formed into the roller type. When the guides are not roller guides, the effect yarn is brought into frictional contact with the guides, thus being unexpectedly drawn and failing to have a desired effect.

On the other hand, the drawing ratio of the core yarn at the first and second godet roller is preferably set to 1.5–5.0 and, more preferably, to 2.0–4.5.

It is well known that the shrinkage differential effect of the mixed yarn is also determined by the number of interlacing of the core and effect yarns. In the method of this invention, the mixed yarn is quickly taken up by the take-up machine so that the number of interlacing in the mixed yarn of this invention is reduced than the mixed yarn produced by a general drawing machine or a separate doubling machine. In order to compensate for the reduced number of interlacing, it is necessary to increase the interlacing air pressure to a high pressure, which does not cause any fluff on the resulting mixed yarn. It is preferable to set the interlacing air pressure to 1.5–4.5 kgf/cm$^2$ and, more preferably, to 2.0–4.0 kgf/cm$^2$. In such a case, the average number of interlacing in the mixed yarn is 35 per 1 m of mixed yarn. When the interlacing air pressure is lower than the above pressure, the number of interlacing is not higher than 20, thus failing to expect the desired shrinkage differential effect. Meanwhile, the interlacing air pressure, which is higher than the above pressure, causes fluff on the resulting mixed yarn.

In accordance with the method of this invention, it is possible to produce a mixed yarn through a spinning and drawing process with a single spin draw spinning machine. The method of this invention thus simplifies the process of producing mixed yarns and reduces the production cost and improves productivity of the mixed yarns in comparison with a known method. The method of this invention also improves the processing effect and prevents a bad appearance of the resulting mixed yarns. Another advantage expected in the method of this invention is that the method uses the same polymer, thus being free from causing the resulting mixed yarn to be ununiformly dyed.

The present invention will be described in detail through the following examples which are set forth to illustrate, but are not to be construed as the limit of the present invention.

EXAMPLE 1

A different shrinkage mixed yarn was produced with the device of FIG. 2. In this example, the core yarn was spun from 24-hole spinnerets and had a staple fineness of 3 denier, while the effect yarn was spun from 96-hole spinnerets and had a staple fineness of 0.7 denier. The rotating speed of the first godet roller is 1,200 m/min, while the rotating speed of the second godet roller is 4,300 m/min. The interlacing air pressure is 2.5 kgf/cm$^2$, while the stepping percentage of the second godet roller is 2.0%. The number of interlacing and the shrinkage differential effect of a resulting mixed yarn are given in table 1.

EXAMPLE 2

A different shrinkage mixed yarn was produced with the device of FIG. 1. In this example, the core yarn was spun from 24-hole spinnerets and had a staple fineness of 3 denier, while the effect yarn was spun from 96-hole spinnerets and had a staple fineness of 0.7 denier. The rotating speed of the first godet roller is 1,200 m/min, while the rotating speed of the second godet roller is 4,300 m/min. The interlacing air pressure is 2.5 kgf/cm$^2$. The number of interlacing and the shrinkage differential effect of the resulting mixed yarn are given in table 1.

EXAMPLE 3

The process of example 2 was repeated with a core yarn, which was spun from 12-hole spinnerets and had a staple fineness of 6 denier, and an effect yarn, which was spun from 72-hole spinnerets and had a staple fineness of 1 denier.

EXAMPLE 4

The process of example 2 was repeated with the rotating speed of the first godet roller being 1,500 m/min and the rotating speed of the second godet roller being 4,500 m/min.

EXAMPLE 5

The process of example 1 was repeated with a core yarn, which was spun from 12-hole hollow spinnerets and had a staple fineness of 6 denier, and an effect yarn, which was spun from 72-hole spinnerets and had a staple fineness of 1 denier.

EXAMPLE 6

The process of example 1 was repeated with an interlacing air pressure of 3.5 kgf/cm$^2$.

EXAMPLE 7

The process of example 1 was repeated with the stepping percentage of the second godet roller being set to 3.0%.

COMPARATIVE EXAMPLE 1

The process of example 1 was repeated with a core yarn, which was spun from 72-hole spinnerets and had a staple fineness of 1 denier, and an effect yarn, which was spun from 48-hole spinnerets and had a staple fineness of 1.5 denier.

COMPARATIVE EXAMPLE 2

The process of example 1 was repeated with a core yarn, which was spun from 12-hole spinnerets and had a staple fineness of 6 denier, and an effect yarn, which was spun from 72-hole spinnerets and had a staple fineness of 1 denier, and the rotating speed of the first godet roller of 3,000 m/min, and the rotating speed of the second godet roller of 5,300 m/min.

COMPARATIVE EXAMPLE 3

A mixed yarn is produced with a core yarn, which was spun from 24-hole spinnerets and had a staple fineness of 3 denier, and an effect yarn, which was spun from 96-hole spinnerets and had a staple fineness of 0.7 denier, and the rotating speed of the first godet roller of 1,500 m/min and the rotating speed of the second godet roller of 4,500 m/min. In this example, the core yarn passed through a normal direct drawing yarn passage including the first and second godet roller, while the effect yarn passed over an additional fixed guide positioned under the first and second godet rollers. The core and effect yarns were mixed together at the rotating speed of the take-up machine prior to being taken up by the take-up machine.

COMPARATIVE EXAMPLE 4

The process of example 1 was repeated with an interlacing air pressure of 5.0 kgf/cm$^2$.

COMPARATIVE EXAMPLE 5

The process of example 1 was repeated with the stepping percentage of the second godet roller being set to 7%.

COMPARATIVE EXAMPLE 6

The process of example 1 was repeated with the stepping percentage of the second godet roller being set to 0.5%.

TABLE 1

| | process effect | shrinkage difference* (%) | number of interlacing (n/m) | fluff (n/$10^6$ m) | reaction elasticity** | coiling |
|---|---|---|---|---|---|---|
| Ex. 1 | good | 26 | 38 | x | Δ | x |
| Ex. 2 | good | 25 | 24 | x | Δ | x |
| Ex. 3 | good | 33 | 35 | x | ○ | x |
| Ex. 4 | good | 21 | 29 | x | Δ | x |
| Ex. 5 | good | 31 | 33 | x | ◎ | x |
| Ex. 6 | good | 24 | 43 | x | Δ | x |
| Ex. 7 | good | 26 | 50 | x | Δ | x |
| CE. 1*** | good | 8 | 35 | x | Δ | x |
| CE. 2 | good | 3 | 19 | x | Δ | x |
| CE. 3 | bad | 9 | 27 | 25 | impossible to weave | x |
| CE. 4 | good | 24 | 40 | 45 | impossible to weave | x |
| CE. 5 | bad | 23 | 45 | x | impossible to take up | coiling |
| CE. 6 | good | 25 | 25 | x | Δ | x |

*difference in thermal shrinkage, the difference is resulted from subtracting the thermal shrinkage percentage of a sized effect yarn from the thermal shrinkage percentage of a sized core yarn.
**◎ = very good, ○ = good, Δ = normal
***comparative example

EXAMPLE 8

A different shrinkage mixed yarn was produced with the device of FIG. 2. In this example, the core yarn was spun from 24-hole spinnerets and had both a staple fineness of 3 denier and a thermal shrinkage percentage of 15%, while the effect yarn was spun from 96-hole spinnerets and had both a staple fineness of 0.7 denier and a thermal shrinkage percentage of 8%. The rotating speed of the first godet roller is 1,200 m/min, while the rotating speed of the second godet roller is 4,300 m/min. The temperature of the second godet roller is 100° C. The interlacing air pressure is 2.5 kgf/cm$^2$, while the stepping percentage of the second godet roller is 2.0%. The processing effect, shrinkage differential effect, number of interlacing, fluff and dyeing effect of the resulting mixed yarn are given in table 2.

EXAMPLE 9

The process of example 8 was repeated with a basic color dyed yarn used as the effect yarn. The resulting mixed yarn was sized and woven through a plain weaving process, and dyed with Gaya cream basic dyes (Red, RGL-ED) manufactured by Japan Chemical Co. The processing effect, shrinkage differential effect, number of interlacing, fluff and dyeing effect of the resulting mixed yarn are given in table 2.

EXAMPLE 10

The process of example 8 was repeated with deep color polyester resin used as the effect yarn. The resulting mixed yarn was sized, woven and dyed with general disperse dyes. The processing effect, shrinkage differential effect, number of interlacing, fluff and dyeing effect of the resulting mixed yarn are given in table 2.

EXAMPLE 11

The process of example 8 was repeated with dull polyester resin used as the effect yarn. The processing effect, shrinkage differential effect, number of interlacing, fluff and dyeing effect of the resulting mixed yarn are given in table 2.

TABLE 2

| | process effect | shrinkage difference (%) | number of interlacing (n/m) | fluff (n/$10^6$ m) | dyeing effect |
|---|---|---|---|---|---|
| Ex.8 | good | 32 | 38 | x | normal effect |
| Ex.9 | good | 25 | 35 | x | melange effect |
| Ex.10 | good | 24 | 35 | x | deep color effect |
| Ex.11 | good | 25 | 35 | x | dim polishing effect |

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of producing a different shrinkage mixed yarn using core and effect yarns, said core and effect yarns being selected from the same or different polymer and having different thermal shrinkage percentages, comprising the steps of:

spinning the core and effect yarns from different spinnerets of a spin draw spinning machine; and doubling and interlacing the core and effect yarns into a different shrinkage mixed yarn prior to taking up the different shrinkage mixed yarn, with the core yarn passing through a direct drawing yarn passage including two or more godet rollers and the effect yarn passing through a bypassed yarn passage free from drawing the effect yarn.

2. The method according to claim 1, wherein said effect yarn is doubled and interlaced with said core yarn at an interlacing nozzle positioned in the front of a take-up machine, said effect yarn passing over first and second bypass rollers prior to being fed into said interlacing nozzle and said core yarn passing over first and second godet rollers prior to being fed into the interlacing nozzle, said first and second bypass rollers being rotated in conjunction with the take-up machine.

3. The method according to claim 1, wherein said core yarn passes over a first godet roller and a large diameter part of a second stepped godet roller in that order, while said effect yarn passes over a first bypass roller and a small diameter part of the second godet roller in that order, said core and effect yarns being doubled at the second godet roller.

4. The method according to claim 3, wherein said second godet roller has a stepping percentage of 2.0–7.0%.

5. The method according to claim 1, wherein the mixed yarn is taken up at a winding speed of 2,000–5,000 m/min.

6. The method according to claim 1, wherein said core and effect yarns are interlaced at an interlacing air pressure of 1.5–4.5 kgf/cm$^2$.

7. The method according to claim 1, wherein the staple fineness of said core yarn is 2–10 denier.

8. The method according to claim 1, wherein the staple fineness of said effect yarn is 0.3–6 denier.

9. The method according to claim 1, wherein said core yarn has a circular, hollow, triangular, Y-shaped or flat cross-section.

10. The method according to claim 1, wherein the polymer for the core yarn is polyester including isophthalic acid of 5–20 mol % relative to terephthalic acid.

11. The method according to claim 1, wherein at least one polymer for the core and effect yarns is polyester including dimethylsulfonate of 0.5–5 mol % relative to dimethylterephthalic acid.

12. The method according to claim 1, wherein at least one for the core and effect yarns is a deep color yarn.

13. The method according to claim 1, wherein said core and effect yarns are separately selected from the group consisting of semi-dull polymer, full-dull polymer and bright polymer, thus being different from each other.

* * * * *